US006537165B1

(12) United States Patent
Mockenhaupt et al.

(10) Patent No.: US 6,537,165 B1
(45) Date of Patent: Mar. 25, 2003

(54) GAME RACQUET WITH SEPARATE HEAD AND HANDLE PORTIONS

(75) Inventors: Martin Mockenhaupt, Buffalo Grove, IL (US); Po-Jen Cheng, Oak Brook, IL (US); David W. Repetto, Chicago, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 10/000,915

(22) Filed: Nov. 2, 2001

(51) Int. Cl.[7] ..... A63B 49/02
(52) U.S. Cl. ..... 473/521; 473/549
(58) Field of Search ..... 473/520, 521, 473/524, 531, 549, 551, 540

(56) References Cited

U.S. PATENT DOCUMENTS

| | | | | | |
|---|---|---|---|---|---|
| 4,139,194 | A | * | 2/1979 | Fischer | 473/521 |
| 4,360,202 | A | | 11/1982 | Lo | |
| 4,609,198 | A | | 9/1986 | Tarr | |
| 4,906,002 | A | * | 3/1990 | Goffney et al. | 473/531 |
| 4,915,382 | A | * | 4/1990 | Madsen | 473/531 |
| 4,988,100 | A | * | 1/1991 | Shu et al. | 473/531 |
| 5,560,600 | A | * | 10/1996 | FitzSimons et al. | 473/463 |
| 6,071,203 | A | * | 6/2000 | Janes et al. | 473/535 |

FOREIGN PATENT DOCUMENTS

| | | | | |
|---|---|---|---|---|
| DE | 3521621 | * | 1/1986 | 473/FOR 183 |
| DE | 3923268 | * | 1/1991 | 473/FOR 183 |
| EP | 130620 | * | 1/1985 | 473/FOR 183 |
| EP | 519312 | * | 12/1992 | 473/FOR 183 |
| EP | 531806 | * | 3/1993 | 473/FOR 183 |
| WO | 86/04251 | * | 7/1986 | 473/FOR 177 |

OTHER PUBLICATIONS

"The ISIS System" from 1992 Catalog of Dunlop Slazenger Corporation.
"ISIS—Impact Shock Isolation System" from Dunlop 1994 Tennis Catalog.

* cited by examiner

*Primary Examiner*—Raleigh Chiu

(57) ABSTRACT

A game racquet includes a head portion and a pair of removable handle portions. The head portion is adapted to support racquet strings and includes a pair of side portions which curve downwardly and inwardly at the bottom of the head. Each handle portion includes a substantially straight bottom portion and a curved top portion which is frictionally engaged with, and removable from, one of the side portions of the hoop. Dampening or resilient material is positioned between the frictionally engaged portions of the side portions and the handle portions.

22 Claims, 15 Drawing Sheets

FIG 13
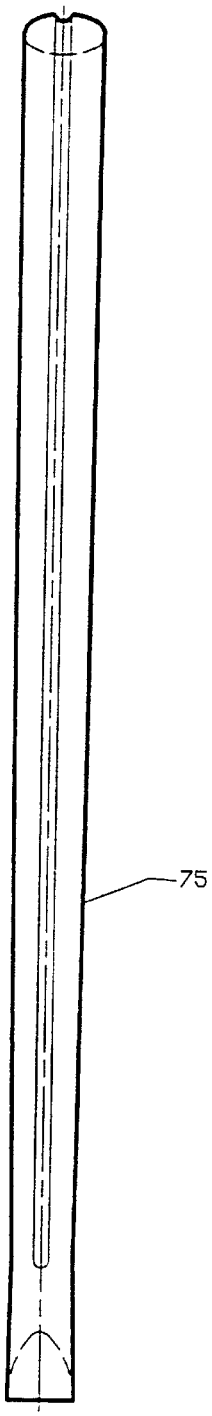
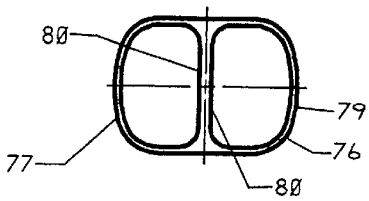
FIG 14
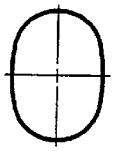
FIG 15
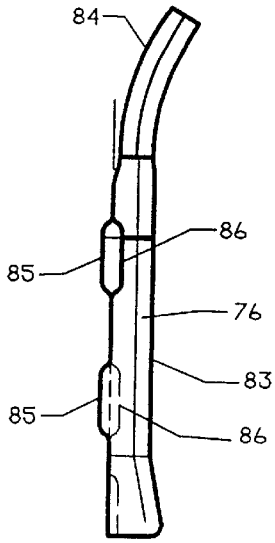
FIG 16

FIG 18
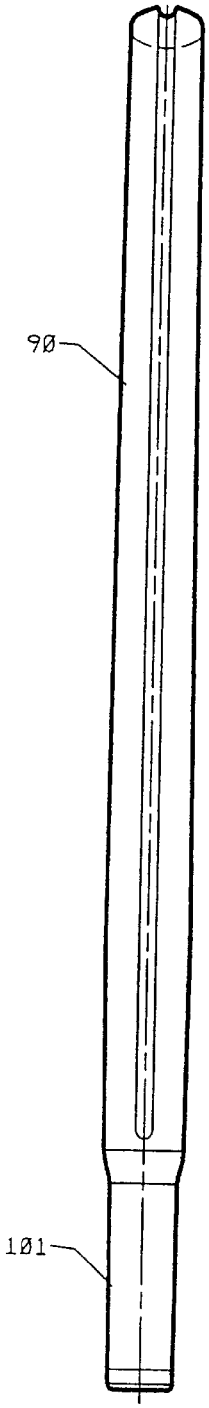
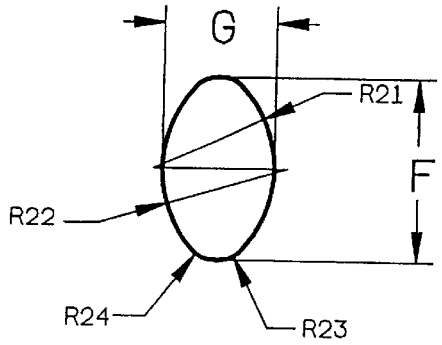
FIG 19
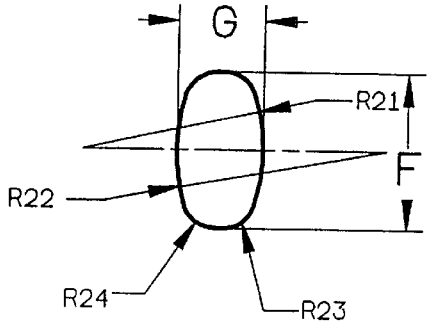
FIG 20
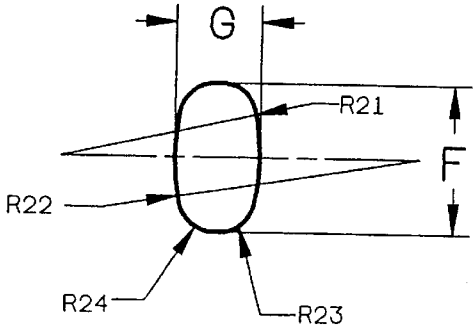
FIG 21

GAME RACQUET WITH SEPARATE HEAD AND HANDLE PORTIONS

BACKGROUND

This invention relates to game racquets, and, more particularly, to a game racquet which includes separate head and handle portions. In the preferred embodiment shock and/or vibration absorbing material is interposed between the head and the handle.

Game racquets such as tennis racquets, racquetball racquets, and squash racquets include a head portion and a handle portion. The head portion supports a string bed, and the player holds the racquet by the handle portion.

Racquets are commonly provided with different size handles. Each handle size is intended to be used by a player with a particular hand size. There have been some attempts to provide racquets with removable handles so that a particular racquet could be fitted with a handle of the desired size. However, many prior art removable handles are heavy, difficult to replace, and/or are not securely attached to the racquet.

When a racquet impacts a ball, shock and vibration is transmitted from the head portion to the handle and thus to the player's arm. The shock and vibration can cause discomfort and fatigue and may cause injuries to the body.

SUMMARY OF THE INVENTION

The invention provides a game racquet with a lightweight removable handle which can be quickly and easily replaced yet which is securely attached to the racquet. The invention utilizes the conventional wedge-shaped throat portion of the racquet to provide a frictional and/or mechanical interlock between the head and the handle. The head includes a pair of curved throat portions which are frictionally engaged by similarly curved handle portions. In one embodiment the throat portions are tubular, and the handle portions are separate pieces. Each handle portion is inserted into one of the tubular throat portions. In another embodiment the handle portions have tubular ends which are inserted over the throat portions. In the preferred embodiment, elastomeric or polymeric material is inserted between the throat portions and handle portions to reduce shock and/or vibration or to provide comfort to the player when the racquet impacts a ball.

In the preferred embodiment for squash and racquet-ball racquets, each handle portion is inserted into one of the tubular throat portions in such a manner to permit a string hole to be drilled through each member and a grommet inserted through the string hole to allow the string to form an additional mechanical interlock between the head and the handle.

DESCRIPTION OF THE DRAWINGS

The invention will be explained in conjunction with the attached drawing, in which—

FIG. 13 is a side view of the head portion of FIG. 12;

FIG. 14 is a sectional view taken along the line 14—14 of FIG. 12;

FIG. 15 is a sectional view take along the line 15—15 of FIG. 12;

FIG. 16 is a front view of one of the handles for the head portion of FIG. 12;

FIG. 18 is a side view of the head portion of FIG. 17;

FIG. 19 is a sectional view taken along the line 19—19 of FIG. 17;

FIG. 20 is a sectional view taken along the line 20—20 of FIG. 17;

FIG. 21 is a sectional view taken along the line 21—21 of FIG. 17;

DESCRIPTION OF SPECIFIC EMBODIMENTS

Figure 1:
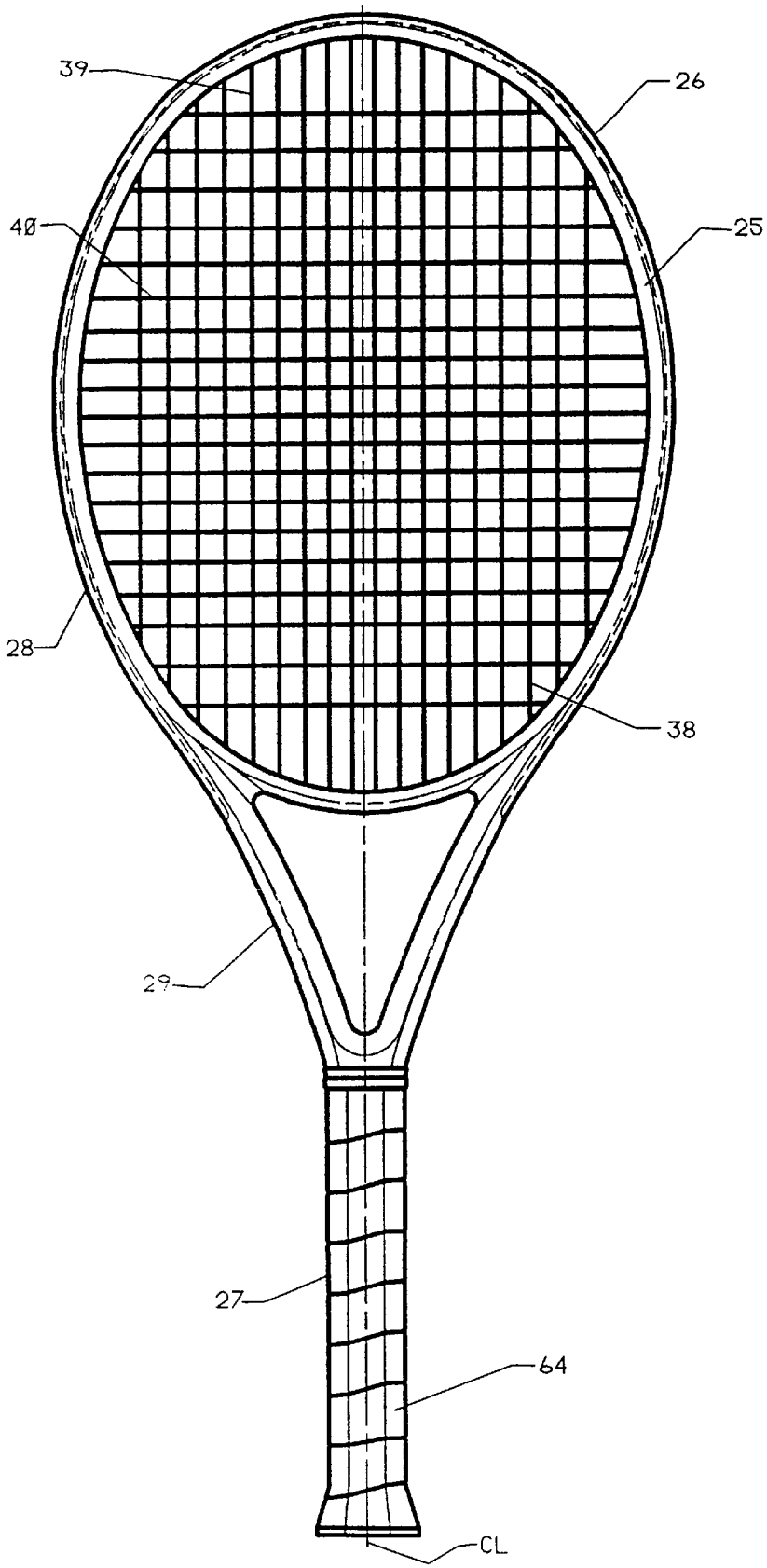
FIG. 1 is a front view of one embodiment of a racquet which is formed in accordance with the invention.
Figure 2:
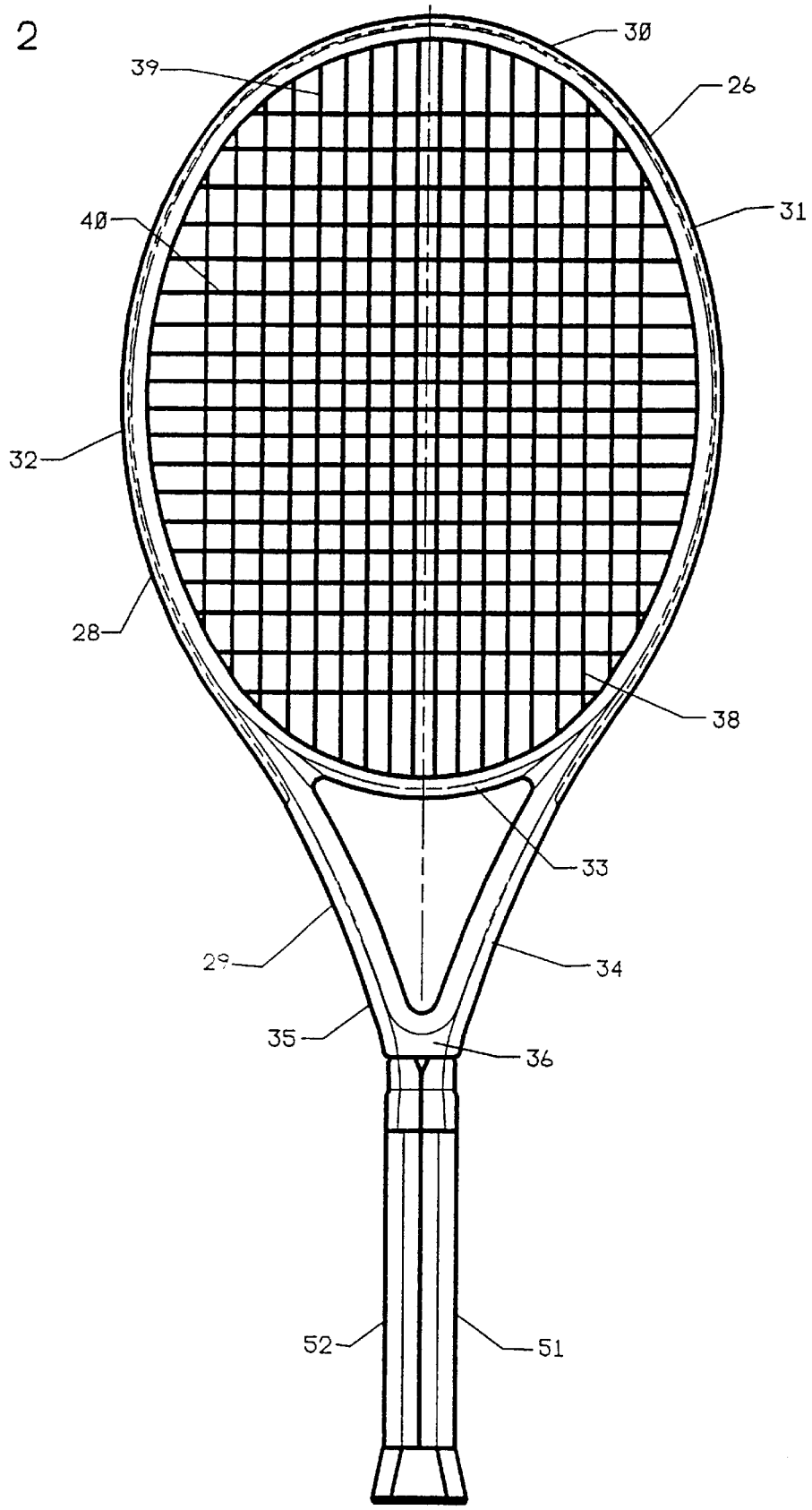
FIG. 2 illustrates the racquet of FIG. 1 with the grip removed.

Referring to FIGS. 1 and 2, a tennis racquet 25 includes a head portion 26 and a handle portion 27. The handle is aligned with a longitudinal centerline CL of the racquet. The particular racquet illustrated in FIGS. 1 and 2 is a tennis racquet. However, it will be understood that the invention can be used with other game racquets such as racquetball racquets and squash racquets.

The head portion includes a hoop 28 and a generally V-shaped or wedge-shaped throat 29. The hoop includes a top portion 30, side portions 31 and 32, and a bottom or yoke portion 33. The throat includes a pair of arms 34 and 35 which curve downwardly and inwardly from the sides of the hoop and which are formed by the sides of the head. The lower ends of the arms 34 and 35 are joined together at 36. The yoke 33 extends between the arms 34 and 35.

A string bed 38 is supported by the hoop 28 in the conventional manner. The string bed includes longitudinally extending main strings 39 and cross strings 40.

Figure 5:
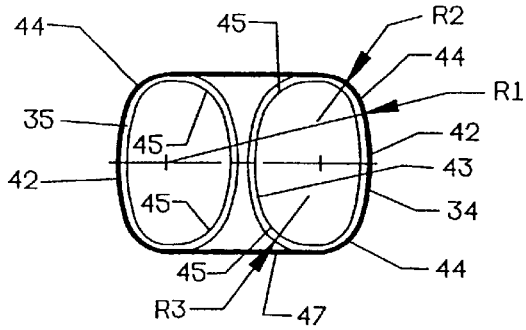
FIG. 5 is a view taken along the line 5—5 of FIG. 3.

Referring to FIG. 5, the lower ends of the arms 34 and 35 are tubular or hollow and have a generally oval shape. However, other shapes could be used. In one specific embodiment the lower end of each arm included a pair of side portions 42 and 43 having a radius of curvature $R_1$ on the outside surface of 1.125 inch, a pair of curved side portions 44 which extended from side portion 42 and which has a radius of curvature $R_2$ on the outside surface of 0.349 inch, and a pair of curved side portions 45 which extended from side portion 43 and which had a radius of curvature $R_3$ of 0.306 inch.

Figure 6:
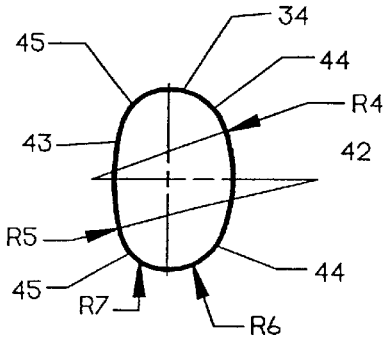
FIG. 6 is a sectional view taken along the line 6—6 of FIG. 3.

At section 6—6 which is illustrated in FIG. 6, the side portions 42 and 43 had radii of curvature $R_4$ and $R_5$ of 0.788 and 1.125 inch, respectively, the curved portions 44 had a radius of curvature $R_6$ of 0.296 inch, and the curved portions 45 had a radius of curvature of 0.272 inch.

Figure 3:
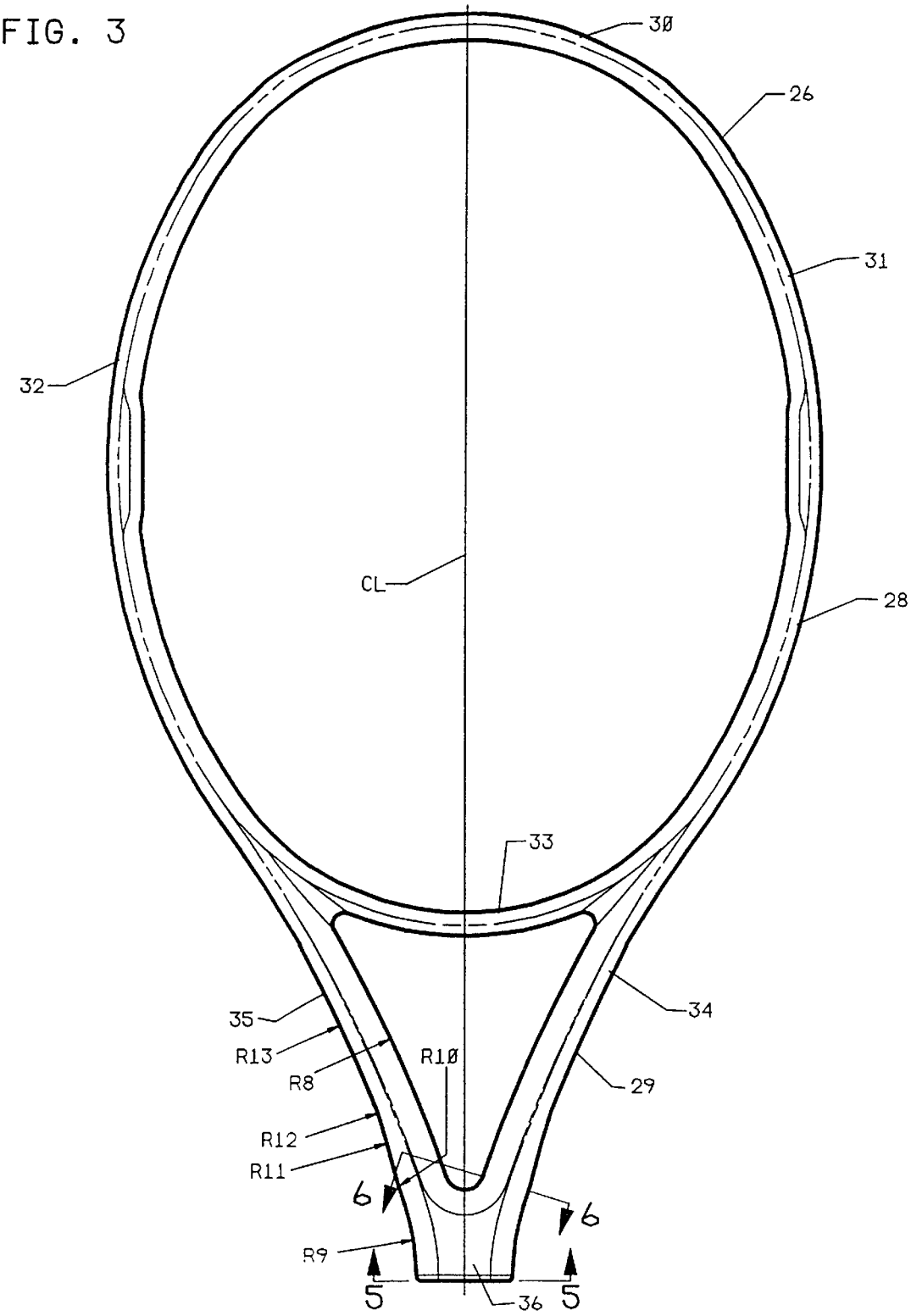
FIG. 3 illustrates the head portion of the racquet.

Referring to FIG. 3, the inside side portion of each of the arms 34 and 35 in one specific embodiment had a radius of curvature $R_8$ of 21.988 inches. The outside side portion had radii of curvature $R_9$–$R_{13}$ of 3.406 inches, 9.846 inches, 27.320 inches, 2.645 inches, and 27.654 inches, respectively. The radii $R_{10}$ and $R_{12}$ provide reverse bends in the outside wall of the arms 34 and 35.

Figure 4:
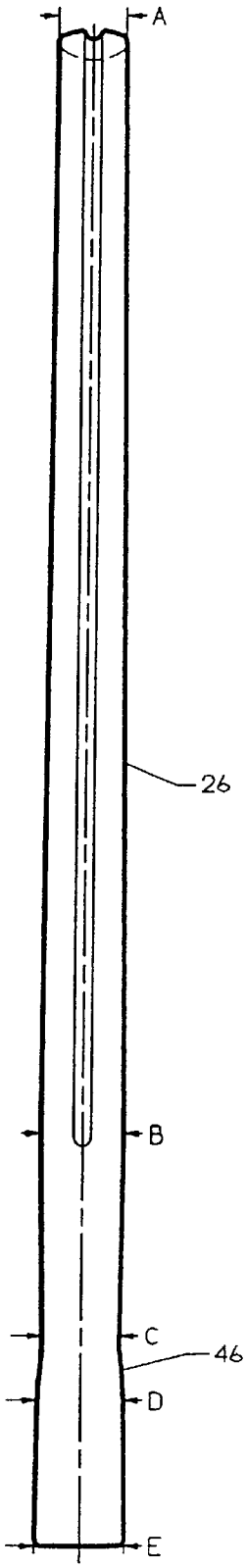
FIG. 4 is a side view of the head portion.

Referring to FIG. 4, the depth of the head portion has a dimension A at the top, a dimension B at the yoke, and a dimension C below the yoke. The lower ends of the arms 34 and 35 flare outwardly at 46 to a dimension D and continue to flare outwardly to a dimension E. In the aforementioned specific embodiment, the dimensions A–E were 0.906 inches, 1.102 inches, 1.025 inches, 1.148 inches, and 1.186 inches, respectively.

The head portion of the racquet can be made in the same manner as conventional composite racquets which are formed from resin and fibers, for example, graphite fibers. A tube or hairpin of fiber and resin forms the top and sides of the hoop and the arms 34 and 35. The lower ends of the arms may be joined together by a wrap 47 (FIG. 5) of fiber and resin (pre-preg) tape. However, other means for connecting the arms together can be used so that the arms do not move relative to each other. The yoke 33 may be formed from a tube of fiber and resin which is filled with a foamable resin. The tube is joined to the arms 34 and 35 by pre-preg tape. The head is inserted into a two-part mold which has a mold cavity in the desired shape of the head. The hairpin is inflated, and the resin is cured under heat and pressure.

Figure 7:
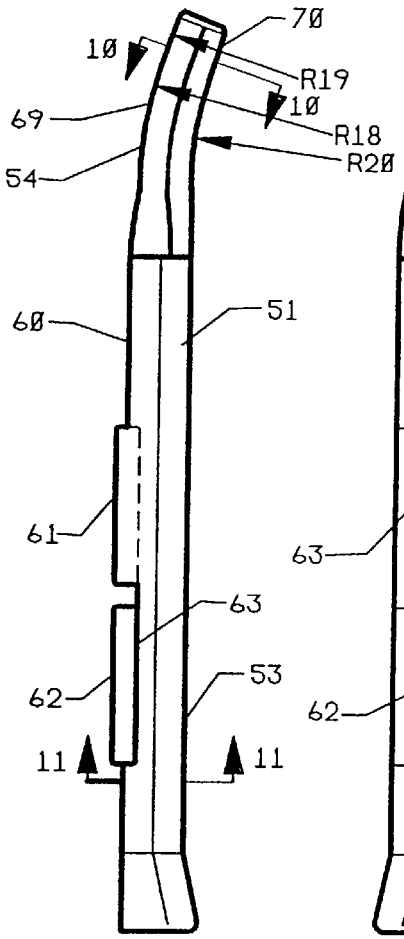
FIG. 7 is a front view of one of the handles of the racquet.
Figure 11:
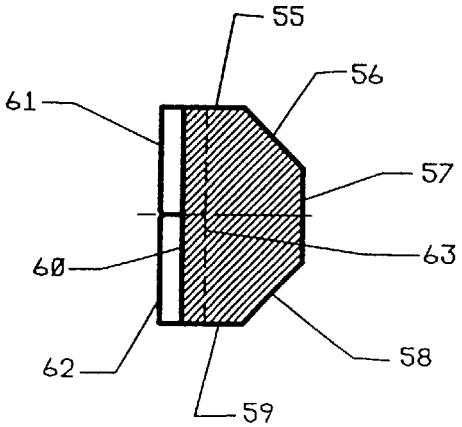
FIG. 11 is a sectional view taken along the line 11—11 of FIG. 7.

The handle portion 27 includes a pair of handle parts 51 and 52 (FIGS. 2 and 7). Each handle part includes a relatively straight lower portion 53 and a curved upper portion 54 which is inserted into one of the tubular arms 34 and 35. Referring to FIG. 11, each handle part includes five outside side surfaces 55–59 and a flat inside side surface 60.

Figure 8:
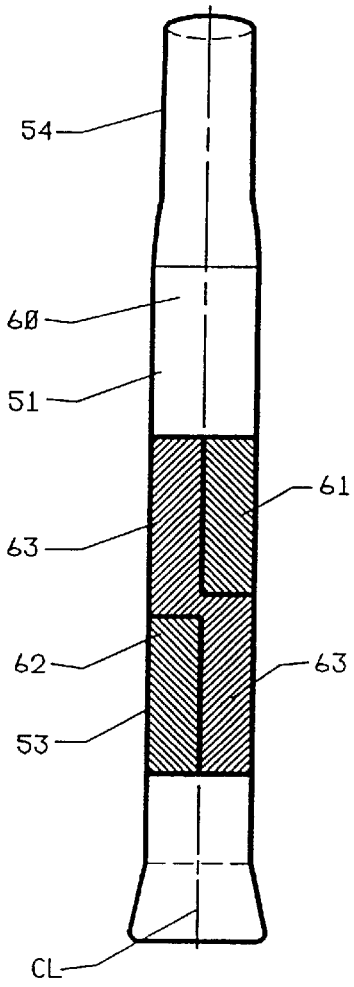
FIG. 8 is a left side view of the handle of FIG. 7.
Figure 9:
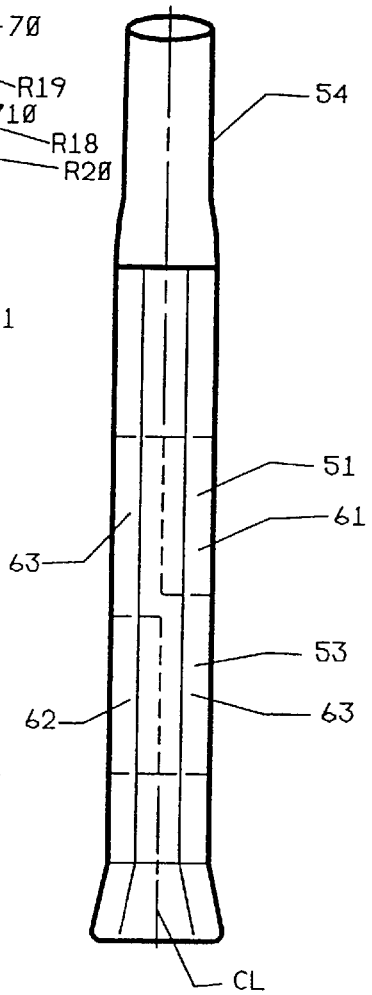
FIG. 9 is a right side view of the handle of FIG. 7.

A pair of rectangular projections 61 and 62 extend beyond the inside surface 60. Referring to FIGS. 8 and 9, the projections are on opposite sides of the longitudinal centerline CL of the handle, and the width of each projection is about one-half of the width of the handle. A recessed portion 63 on the other side of the centerline from each of the projections extends toward the outside surface 57 beyond the surface 60.

The handle parts 51 and 52 are made from the same mold. When the handle parts 51 and 52 abut each other along their inside surfaces 60, the projections 61 and 62 of each handle part extend into the recessed portions 63 of the other handle part. The handle parts are thereby prevented from shifting relative to each other.

After the handle parts are inserted into the arms 34 and 35, the inside surfaces 60 abut each other along the centerline CL of the racquet, and the outside side surfaces 55-59 form the conventional hexagonal shape of a racquet handle or pallet. Grip tape 64 (FIG. 1) is spirally wound around the handle parts, and the wrapped handle has the same appearance as a conventional handle.

Figure 10:
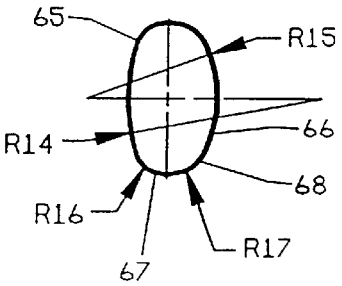
FIG. 10 is a sectional view taken along the line 10—10 of FIG. 7.

Referring to FIG. 10, the upper end 54 of each handle part has a somewhat oval cross section and includes inner and outer curved surfaces 65 and 66 and curved surfaces 67 and 68 which extend from the surfaces 65 and 66, respectively. In the aforementioned specific embodiment, the inner curved surface 65 had a radius of curvature $R_{14}$ of 1.012 inches, and the outer curved surface 66 had a radius curvature $R_{15}$ of 0.704 inch. The surfaces 67 and 68 had a radii of curvature and $R_{17}$ of 0.150 inch and 0.231 inch, respectively.

Referring to FIG. 7, the upper end 54 of each handle part includes inner and outer curved surfaces 69 and 70. The inner surface 69 curves along radii $R_{18}$ and $R_{19}$ of 4.295 inches and 28.202 inches. The outer surface curves along radius $R_{20}$ of 3.504 inches.

The curvatures of the handle parts 51 and 52 are different than the curvatures of the arms 34 and 35 of the head. When the handle parts are inserted into the arms, they exert forces on the handle parts and the arms which deform the curved surfaces enough to allow the handle parts to be inserted. The deformation creates forces which restrain removal of the handle parts from the arms. However, the handle parts can be removed from the arms by exerting enough force to overcome those forces.

Figure 36:
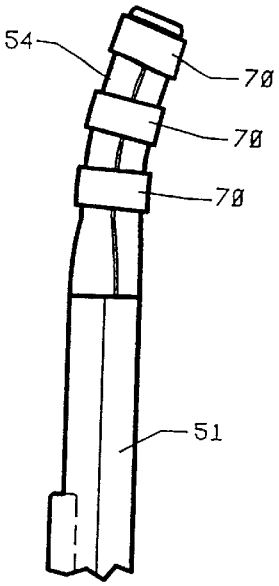
FIG. 36 is a fragmentary view of the handle of FIG. 7 with bands of shock-absorbing material.
Figure 37:
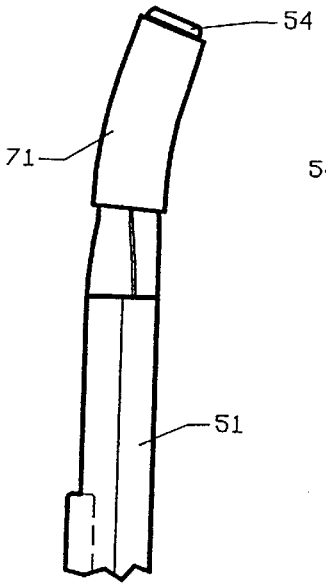
FIGS. 37 and 38 are views similar to FIG. 36 showing a tube and o-rings, respectively, of shock-absorbing material.
Figure 38:
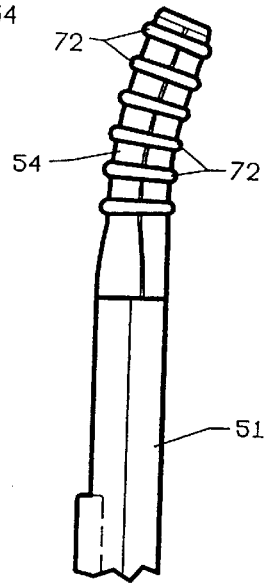

In the preferred embodiment, elastomeric or polymeric material is inserted between the upper ends of the handle parts and the arms 34 and 35. The elastomeric or polymeric material can be material for dampening or absorbing shock and/or vibration or can be resilient material for providing comfort to the player when the racquet impacts a ball. Specific materials include rubber, epoxidized natural rubber, urethane, EVA, or other material which dampens or absorbs shocks and/or vibrations, and polybutadiene, rubber, or other resilient material. Referring to FIGS. 36–38, the elastomeric or polymeric material is advantageously in the shape of a tube or a plurality of bands or o-rings which fit over the end of each handle part. The material separates the head and the handle parts and reduces the transmission of shocks and vibrations from the head to the handle.

In FIG. 36 a plurality of bands or tubes 70 of shock and/or vibration absorbing material or resilient material are slipped over the curved upper end 54 of the handle parts 51 and 52. FIG. 37 illustrates a continuous elongated sleeve or tube 71 of shock-absorbing or resilient material. In FIG. 38 o-rings 72 of shock-absorbing or resilient material are slipped over the upper end of the handle part.

The dampening or resilient material does not have to extend around the handle. Pieces of the material could be attached to the handle parts, for example, by adhesive, or the material could be molded into the handle parts by inserting the material into the mold for the handle part before the part is molded.

The curved upper ends of the handle parts provide a good mechanical interlock between the handle parts and the arms 34 and 35. No adhesive bonding is required, and the handle parts will not separate from the arms during normal tennis play. The size and/or shape of the handle of a racquet can be changed by removing one size or shape of handle parts and inserting handle parts of the desired size or shape.

If shock and/or vibration absorbing material or resilient material is inserted between the head and the handle parts, that material provides additional friction which resists separation of the handle parts from the head.

The handle parts can be formed from graphite and can be filled with foamed resin if desired. Other suitable materials for the handle parts include injection molded nylon, thermoplastics, wood, and other structural materials. The weight and balance of the handle can be adjusted by removing material in various locations along the inside surfaces 60.

Figure 12:
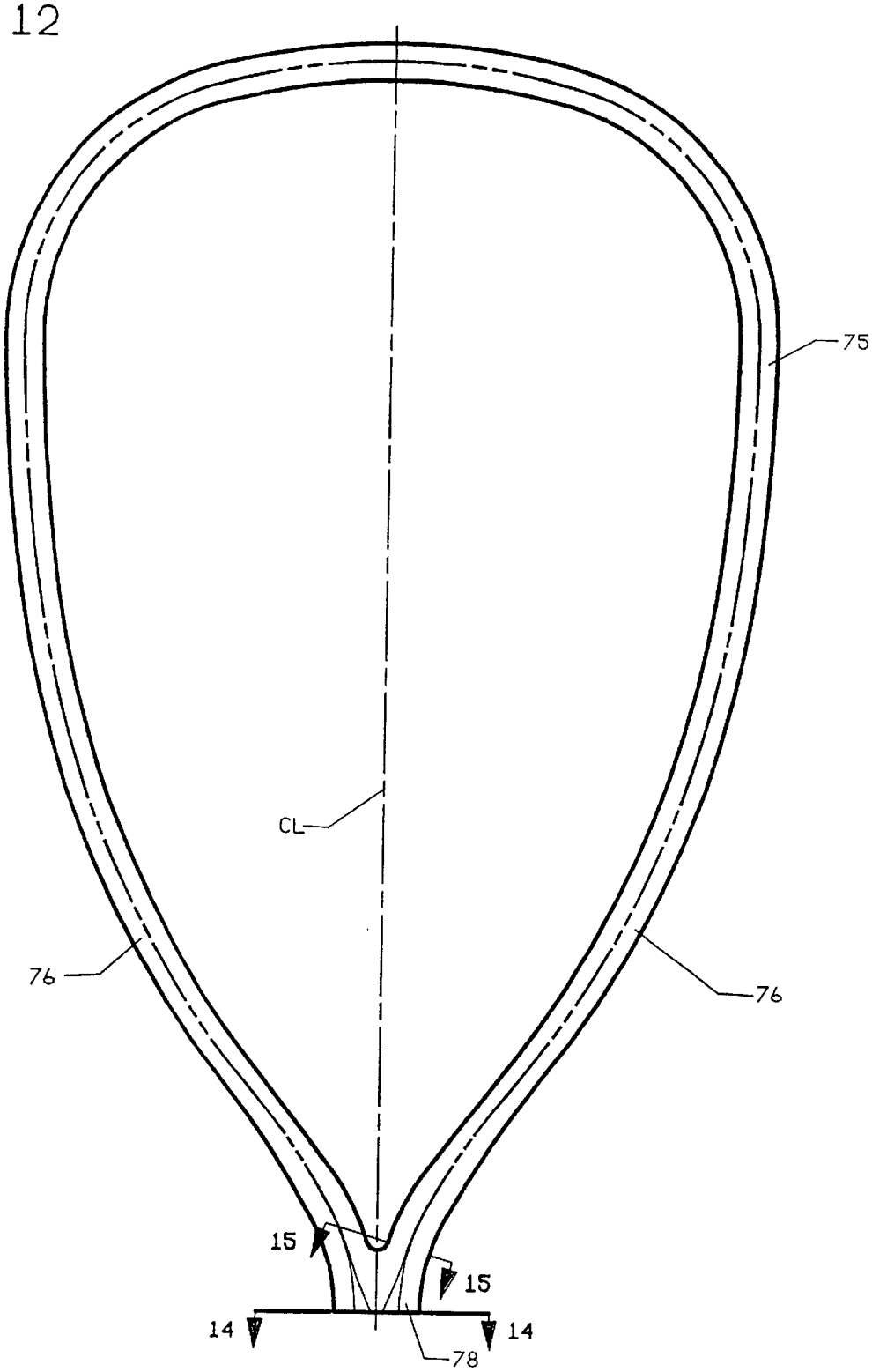
FIG. 12 is a view similar to FIG. 3 of another embodiment of a racquet head.
Figure 17:
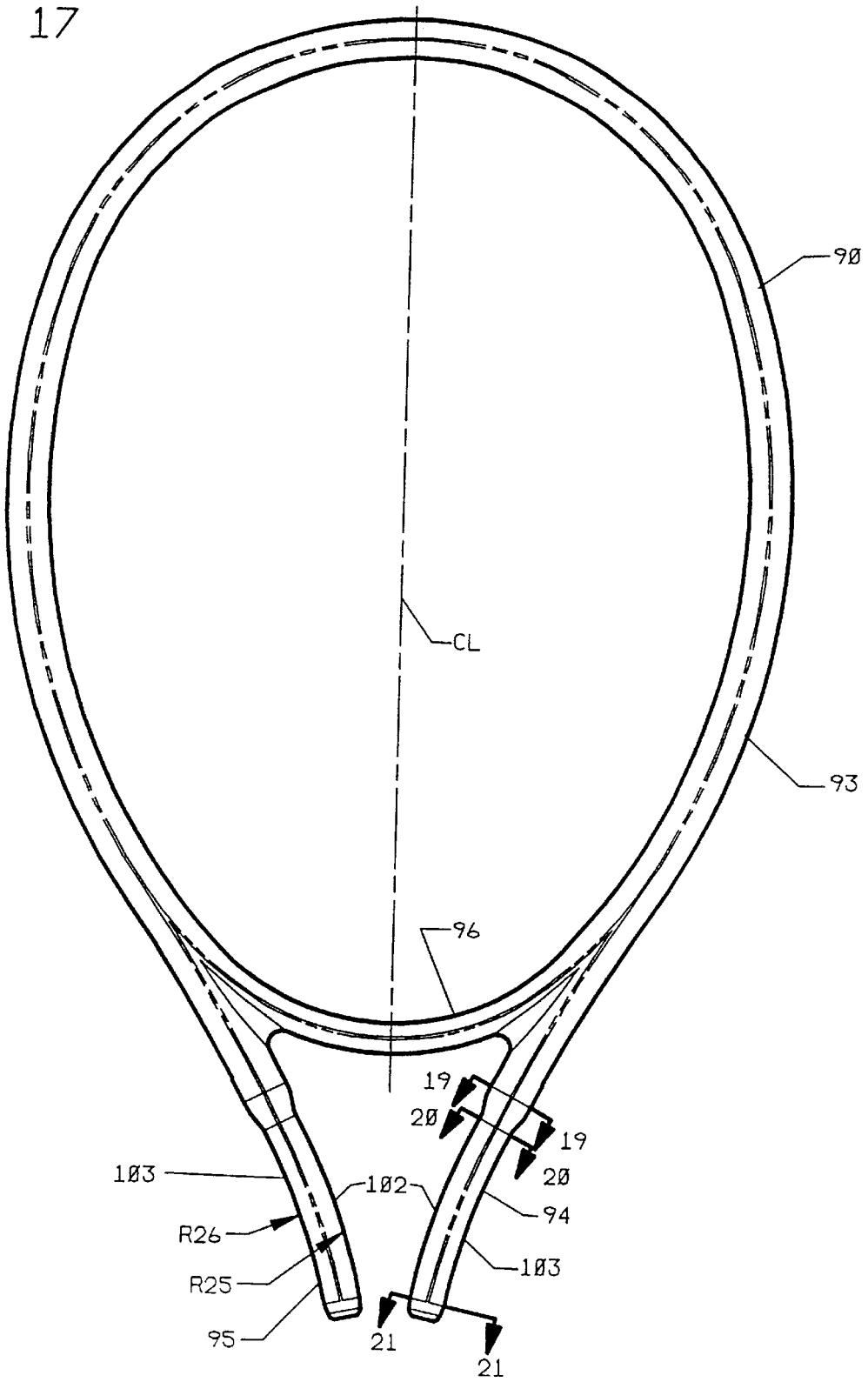
FIG. 17 is a view similar to FIG. 3 of still another embodiment of a racquet head.

FIGS. 12–16 illustrate a racquetball racquet which includes a head 75 and a pair of handle parts 76. Referring to FIG. 12, the head 75 does not include a yoke. Two hollow side portions 76 and 77 of the head curve toward each other to form a throat and are joined at 78.

Referring to FIG. 14, the cross section of the end of each of the side portions 76 and 77 is somewhat D-shaped and includes a curved outer wall 79 and a straight inner wall 80. The two inner walls 80 are joined together. Referring to FIG. 15, the cross section of each of the side portions at section 15–15 is substantially oval.

Referring to FIG. 16, the two handle parts 76 are similar to the handle parts 51 and 52. Each handle part includes a straight lower portion 83 and a curved upper portion 84 which is inserted into one of the hollow side portions 76 or 77 of the head. A pair of projections 85 on each handle part fits into a correspondingly shaped recess 86 on the other handle part.

The shapes and curvatures of the hollow side portions 76 and 77 of the head and of the curved upper ends of the handle parts are selected so that the head and arms are deformed when the handle parts are inserted to provide a good mechanical lock.

Dampening or resilient material, for example, in the shape of bands, a tube, or o-rings as illustrated in FIGS. 36–38, is advantageously positioned on the curved end portion of each of the handle parts.

FIGS. 17–27 illustrate another embodiment of a racquet which includes a head 90 and a pair of handle parts 91. The head portion includes a hoop 93 and a pair of side portions or arms 94 and 95 which curve downwardly and inwardly toward the longitudinal centerline CL of the racquet. A yoke 96 extends between the side portions and forms the bottom of the hoop.

Figure 40:
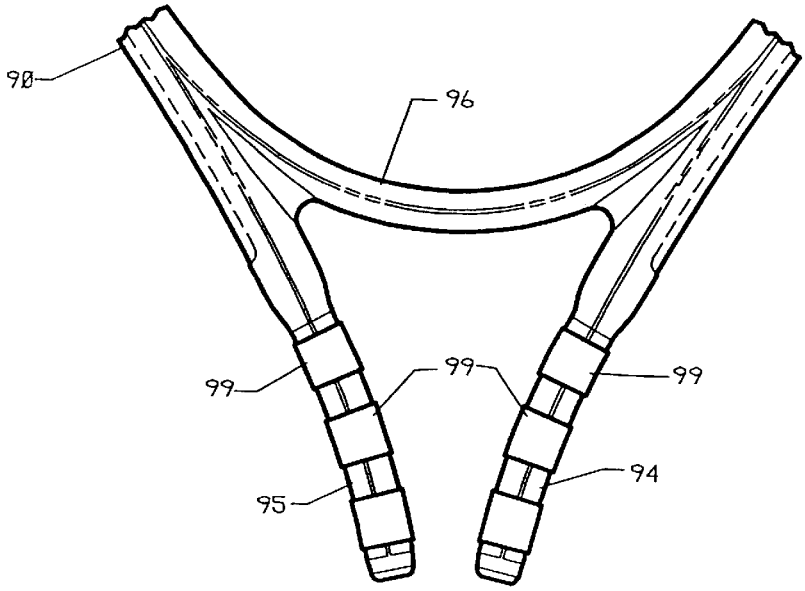
FIG. 40 is a fragmentary view of the head of FIG. 17 with bands of shock-absorbing material.

Each handle part 91 includes a straight portion 97 and a curved, hollow upper end portion 98. The inside surfaces of the hollow end portions 98 are sized to permit insertion of the arms 94 and 95 of the head. Before the arms 94 and 95 are inserted into the handle parts, bands 99 of dampening or resilient material (FIG. 40) may be ensleeved over the arms 94 and 95. Alternatively, a tube or o-rings or other shapes of dampening or resilient material can be used.

In one specific embodiment of the head 90, the arms 94 and 95 of the head flared inwardly from section 19—19 (FIG. 17) to section 20—20 to form an attaching portion 101 which terminates at a shoulder 102. Comparing FIGS. 18–21, the attaching portion 101 tapers inwardly from section 20—20 to section 21—21. The dimensions F and G and the radii of curvature $R_{21}$, $R_{22}$, $R_{23}$, and $R_{24}$ at the three sections are listed in inches in Table 1.

TABLE 1

| | Section 19-19 | Section 20-20 | Section 21-21 |
|---|---|---|---|
| F | 1.155 | 0.993 | 0.972 |
| G | 0.680 | 0.552 | 0.514 |
| $R_{21}$ | 0.775 | 1.090 | 1.204 |
| $R_{22}$ | 0.811 | 1.272 | 1.485 |
| $R_{23}$ | 0.154 | 0.187 | 0.194 |
| $R_{24}$ | 0.179 | 0.200 | 0.206 |

The radius of curvature $R_{25}$ of the inside surface 102 (FIG. 17) of the arms 94 and 95 was 12.429 inches, and the radius of curvature $R_{26}$ of the outside surface 103 was 12.252 inches.

Figure 22:
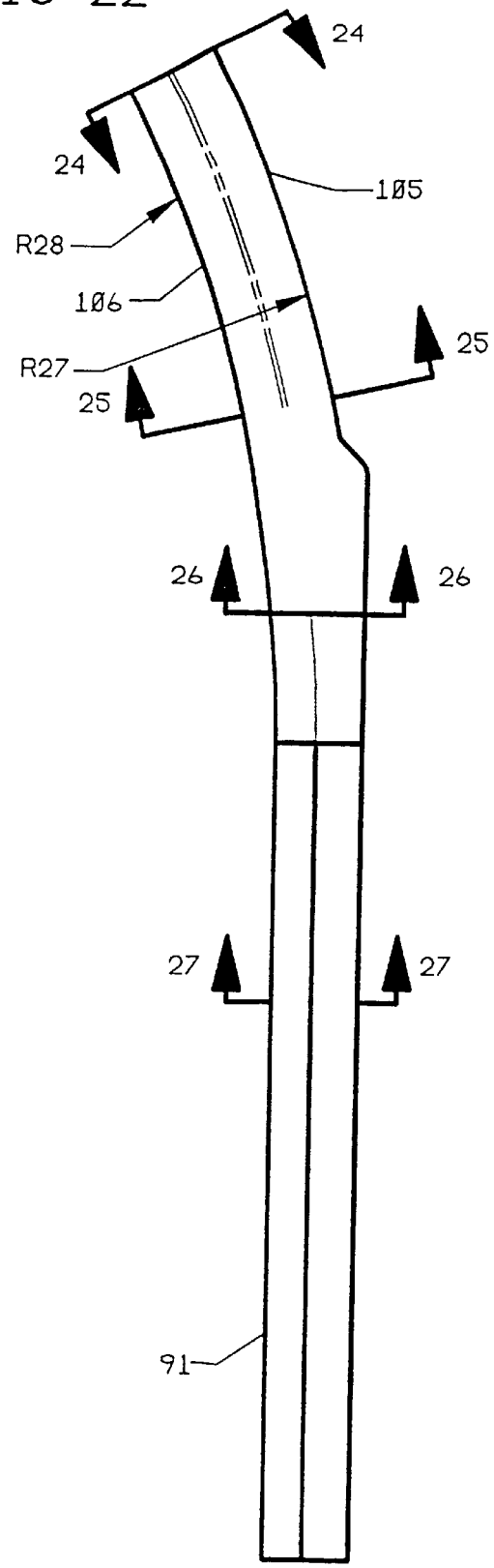
FIG. 22 is a front sectional view of one of the handles for the head portion of FIG. 17.
Figure 23:
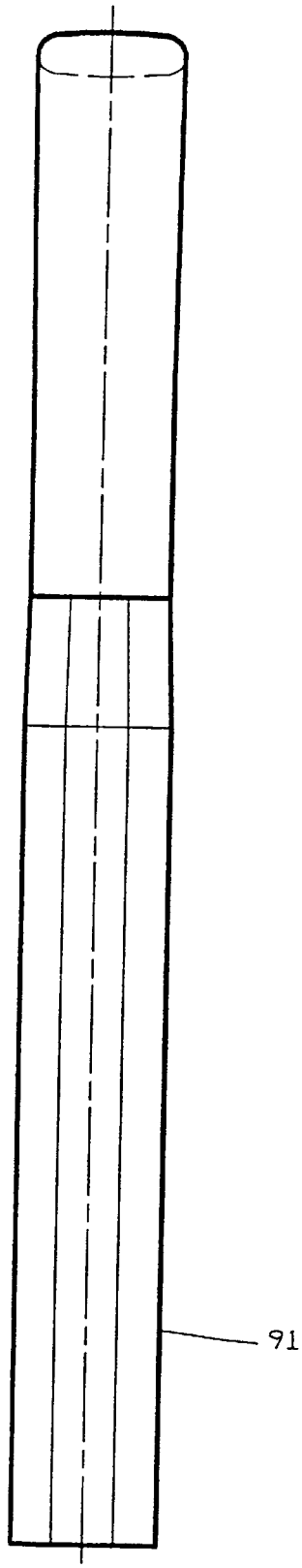
FIG. 23 is a side view of the handle of FIG. 22.
Figure 24:
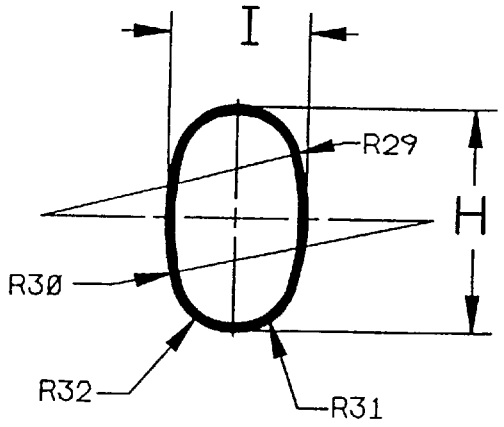
FIG. 24 is an end view taken along the line 24—24 of FIG. 22.
Figure 25:
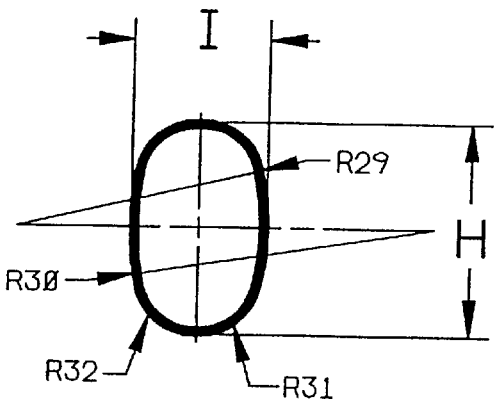
FIG. 25 is a sectional view taken along the line 25—25 of FIG. 22.
Figure 26:
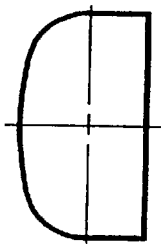
FIG. 26 is a sectional view taken along the line 26—26 of FIG. 22.
Figure 27:
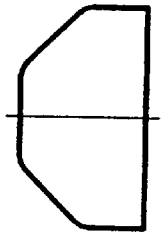
FIG. 27 is a sectional view taken along the line 27—27 of FIG. 22.

Referring to FIG. 22, inside surface 105 of the handle 91 had a radius of curvature $R_{27}$ of 12.572 inches, and outside surface 106 had a radius of curvature $R_{28}$ of 12.154 inches.

The hollow upper end of the handle had dimensions H and I (FIG. 24) of 1.198 inches and 0.719 inch and the following radii of curvature:

| | |
|---|---|
| $R_{29}$ | 1.188 inches |
| $R_{30}$ | 1.370 inches |
| $R_{31}$ | 0.285 inches |
| $R_{32}$ | 0.298 inches |

The hollow end of the handle tapers inwardly from section 24 to section 25. Section 25 had dimensions H and I of 1.167 inches and 0.711 inch and the following radii of curvature:

| | |
|---|---|
| $R_{29}$ | 1.303 inches |
| $R_{30}$ | 1.583 inches |
| $R_{31}$ | 0.293 inch |
| $R_{32}$ | 0.305 inch |

As the arms 94 and 95 of the head are inserted into the upper ends of the handle parts 91, the differences in the curvatures and the tapers deform the material and provide a wedge fit, and the two parts are firmly secured by frictional forces. However, the handle can be removed when desired by exerting enough pulling force to overcome the frictional retention force.

Figure 28:
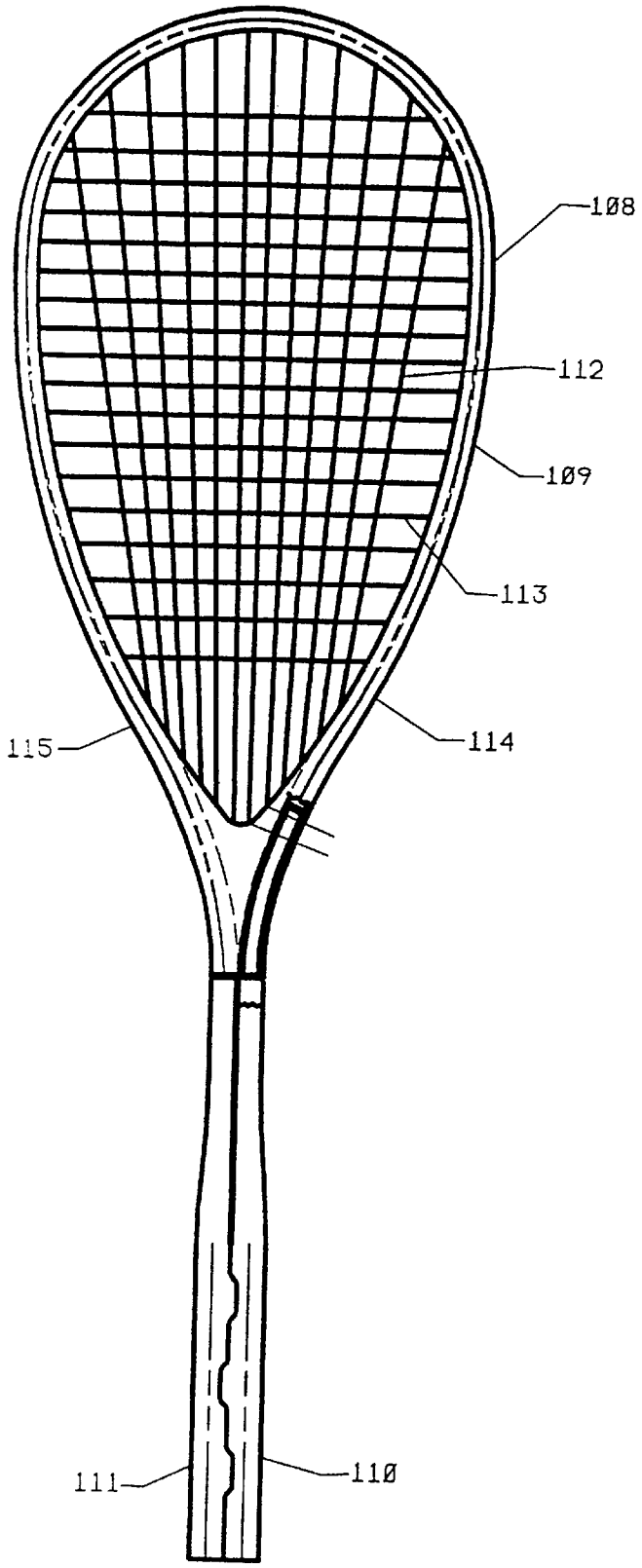
FIG. 28 is a front view partially broken away, of another embodiment of a racquet which is formed in accordance with the invention.

FIG. 28 illustrates a squash racquet 108 which includes a head 109 and a pair of handle parts 110 and 111. The head supports main strings 112 and cross strings 113 which provide a planar strung hitting surface.

Figure 30:
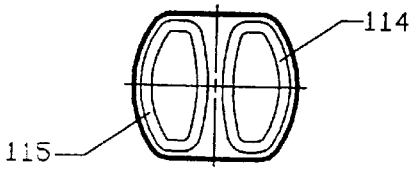
FIG. 30 is a sectional view taken along the line 30—30 of FIG. 29.

The head includes tubular side portions 114 and 115 which are joined at the bottom of the head to form a throat. Referring to FIG. 30, the bottom ends of the side portions are substantially oval or elliptical. However, other shapes can be used.

Figure 31:
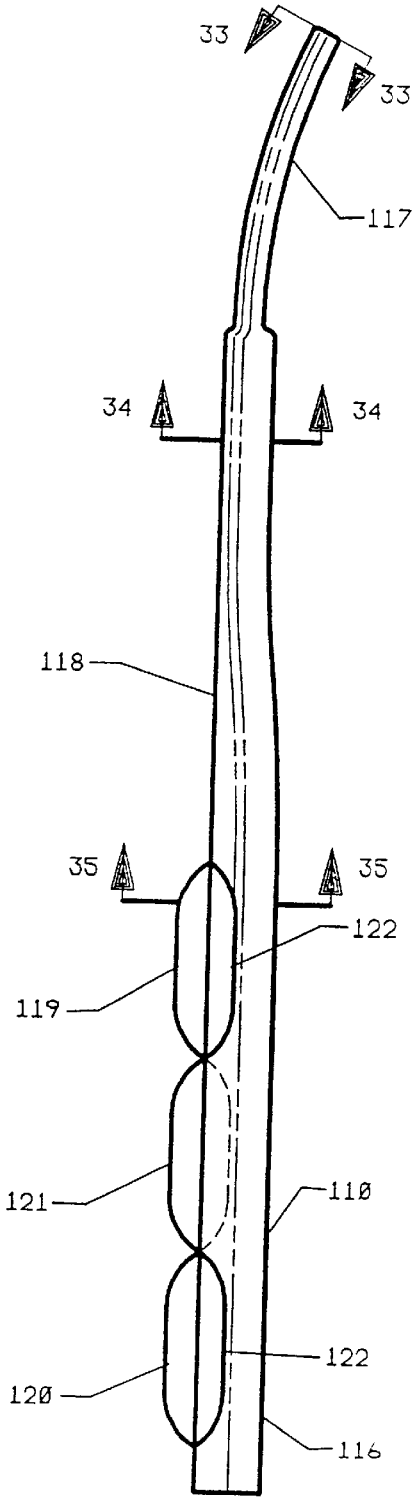
FIG. 31 is a front view of one of the handles of FIG. 28.
Figure 32:
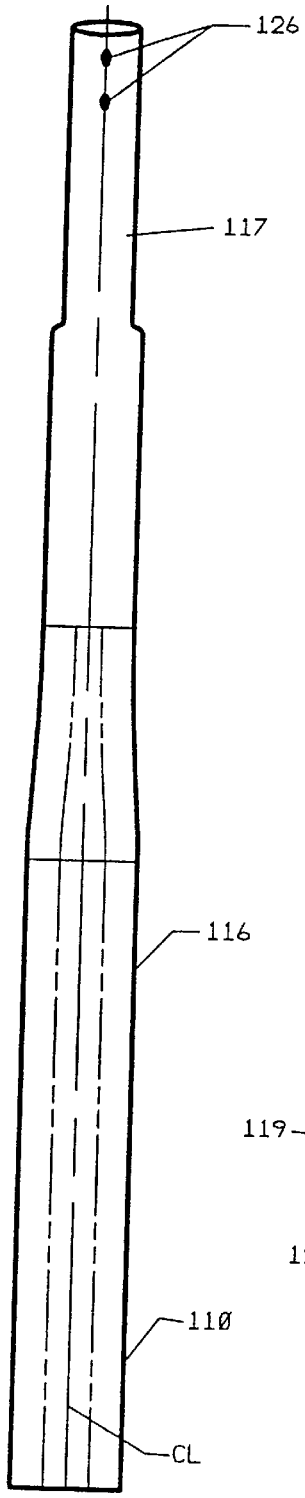
FIG. 32 is a side view of the handle of FIG. 31.
Figure 33:
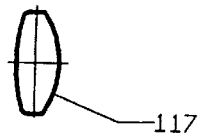
FIG. 33 is an end view taken along the line 33—33 of FIG. 31.
Figure 34:
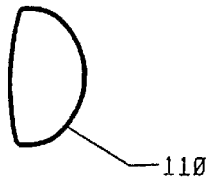
FIG. 34 is a sectional view taken along the line 34—34 of FIG. 31.
Figure 35:
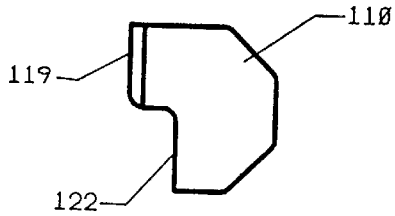
FIG. 35 is a sectional view taken along the line 35—35 of FIG. 31.

Turning to FIGS. 31 and 32, each of the handle parts 110 and 111 includes a straight lower portion 116 and a curved upper portion 117. The lower portion includes a straight inside surface 118. Projections 119 and 120 extend beyond the surface 118 on one side of the longitudinal centerline CL of the handle, and projection 121 is located on the other side of the centerline. The projections of each handle part fit into recesses 122 in the other handle part.

Figure 39:
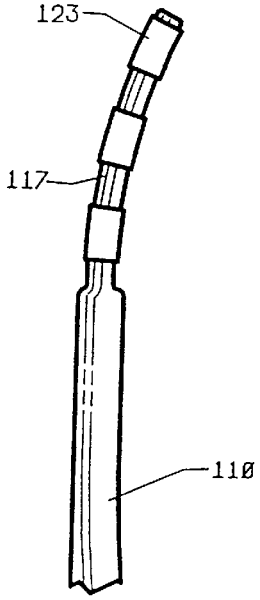
FIG. 39 is a fragmentary view of the handle of FIG. 31 with bands of shock-absorbing material.

Bands 123 (FIG. 39) of shock and/or vibration absorbing material are slipped over the curved upper end of each handle part. Alternatively, a tube or o-rings or other shapes of absorbing material can be used.

The curved upper ends of the handle parts 110 and 111 are inserted into the hollow side portions 114 and 115 of the head 109. The shapes and curvatures of the interfitting parts are such that a mechanical interlock is provided which retains the handle parts in the head during normal play. However, the handle parts can be removed when desired.

Figure 29:
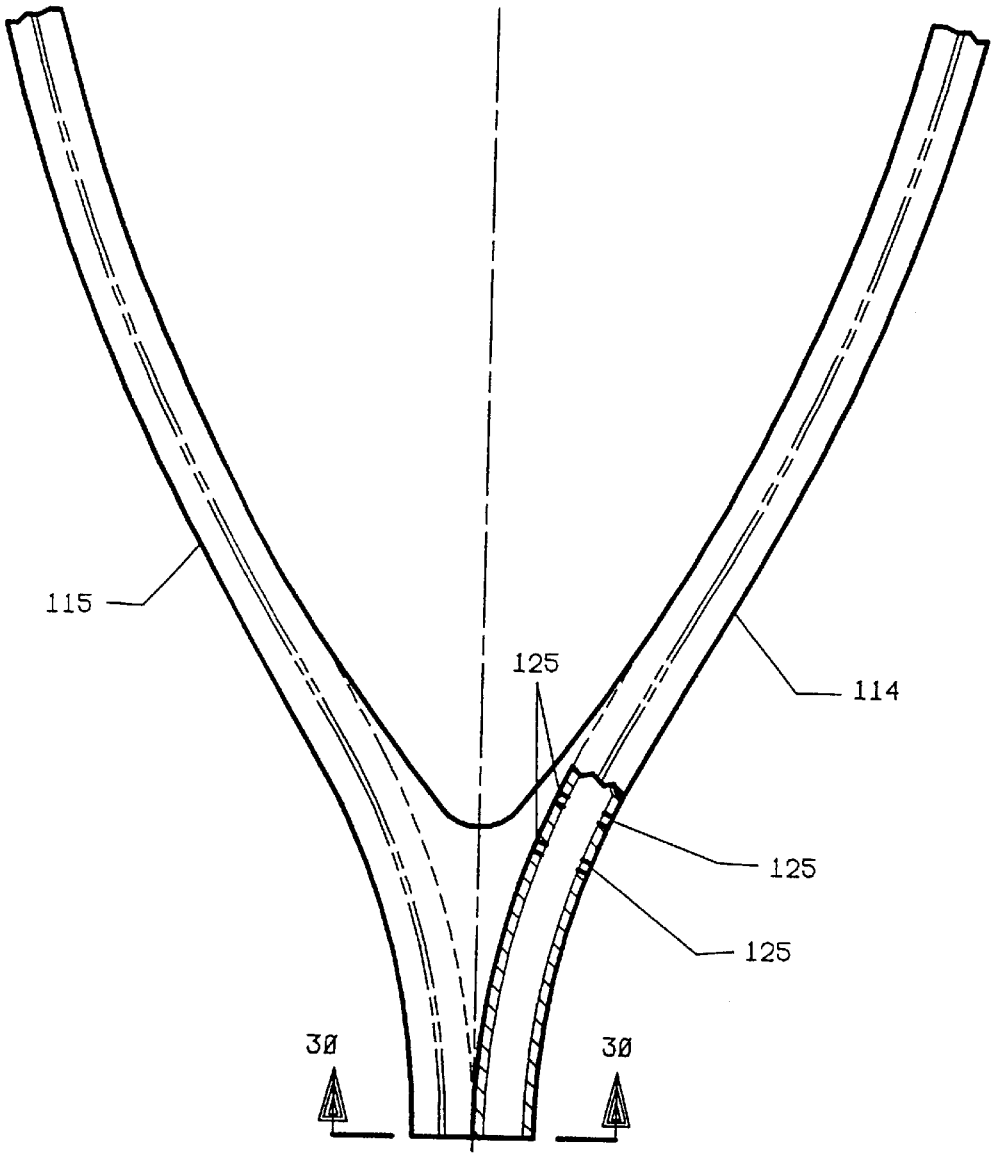
FIG. 29 is a front view, partially broken away, of the head portion of the racquet of FIG. 28.

In the preferred embodiment of the squash racquet, each of the side portions 114 and 115 of the head 109 is provided with string holes 125 (FIG. 29), and the upper end of each of the handle parts 110 and 111 is provided with string holes 126 (FIG. 32). The string holes can be drilled in the head and handle parts either before or after the handle parts are inserted into the head. When the racquet is strung, two of the main strings are inserted through the aligned holes in the head and each handle part to form an additional mechanical interlock between the head and the handle. A conventional grommet can be inserted through each string hole before stringing.

Similar string holes can also be provided I the head and handle parts of tennis and racquetball racquets.

While in the foregoing specification a detailed description of specific embodiments of the invention has been set forth for the purpose of illustration, it will be understood that many of the details hereingiven can be varied considerably by those skilled in the art without departing from the spirit and scope of the invention.

We claim:

1. A game racquet comprising:

a) a head portion, the head portion being adapted to support a string bed and having a top and opposite side portions and a longitudinal centerline, each of the side portions extending downwardly and toward the longitudinal centerline of the head, the head portion having a lower end and at least one opening formed into the lower end of the head portion, and b) a pair of handle portions, each of the handle portions having a substantially straight bottom portion which is positioned adjacent the longitudinal centerline of the head and a curved top portion which curves upwardly and away from the longitudinal centerline of the head and which is frictionally engaged with, and removable from, one of the side portions of the head, the handle portions being inserted into the opening of the head portion.

2. The racquet of claim 1 in which each of the side portions includes a bottom end which is joined to the bottom end of the other side portion.

3. The racquet of claim 1, wherein each of the side portions includes a bottom end, wherein the at least one opening includes a separate bottom end opening defined in the bottom end of each side portion, and wherein the handle portions are inserted into the bottom end openings of the side portions.

4. A game racquet comprising:

a) a head portion, the head portion being adapted to support a string bed and having a top and opposite side portions and a longitudinal centerline, each of the side portions extending downwardly and toward the longitudinal centerline of the head, b) a pair of handle portions, each of the handle portions having a substantially straight bottom portion which is positioned adjacent the longitudinal centerline of the head and a curved top portion which curves upwardly and away from the longitudinal centerline of the head and which is frictionally engaged with, and removable from, one of the side portions of the head, each of said side portions being tubular and the handle portions being separate from each other and the curved top portion of each of the handle portions inserted into one of the tubular side portions, each handle portion including a substantially flat inside surface which abuts the inside surface of the other handle portion.

5. The racquet of claim 1 including material selected from the class of dampening material, absorbing material, and resilient material inserted between the side portions and the handle portions.

6. The racquet of claim 5 in which said material is in the form of bands on the curved top portion of each of the handle portions.

7. The racquet of claim 4 further comprising material selected from the class of dampening material, absorbing material, and resilient material inserted between the side portions and the handle portions.

8. The racquet of claim 7 wherein the material is in the form of bands positioned on the curved top portion of each of the handle portions.

9. A game racquet comprising:

a) a head portion, the head portion being adapted to support a string bed and having a top and opposite side portions and a longitudinal centerline, each of the side portions extending downwardly and toward the longitudinal centerline of the head, b) a pair of handle portions, each of the handle portions having a substantially straight bottom portion which is positioned adjacent the longitudinal centerline of the head and a curved top portion which curves upwardly and away from the longitudinal centerline of the head and which is frictionally engaged with, and removable from, one of the side portions of the head, and c) material selected from the class of dampening material, absorbing material, and resilient material inserted between the side portions and the handle portions the handle portions being separate from each other and each handle portion including a substantially flat inside surface which abuts the inside surface of the other handle portion.

10. The racquet of claim 9 in which each of the handle portions includes a projection which extends beyond the flat inside surface of the handle portion and into a recess in the other handle portion.

11. A game racquet comprising:

a) a head portion, the head portion being adapted to support a string bed and having a top and opposite side portions and a longitudinal centerline, each of the side portions extending downwardly and toward the longitudinal centerline of the head, b) a pair of handle portions, each of the handle portions having a substantially straight bottom portion which is positioned adjacent the longitudinal centerline of the head and a curved top portion which curves upwardly and away from the longitudinal centerline of the head and which is frictionally engaged with, and removable from, one of the side portions of the head, and c) material selected from the class of dampening material, absorbing material, and resilient material inserted between the side portions and the handle portions, said material being in the form of a tube on the curved top portion of each of the handle portions.

12. The racquet of claim 11 in which each of the side portions and each of the handle portions is provided with a string hole for receiving racquet string.

13. A game racquet comprising:

a) a head portion, the head portion being adapted to support a string bed and having a top and opposite side portions and a longitudinal centerline, each of the side portions extending downwardly and toward the longitudinal centerline of the head, b) a pair of handle portions, each of the handle portions having a substantially straight bottom portion which is positioned adjacent the longitudinal centerline of the head and a curved top portion which curves upwardly and away from the longitudinal centerline of the head and which is frictionally engaged with, and removable from, one of the side portions of the head, the top portion of each of the handle portions being inserted into the tubular top portion of one of the handle portions.

14. The racquet of claim 13 including material selected from the class of dampening material, absorbing material, and resilient material inserted between the side portions and the handle portions.

15. The racquet of claim 14 in which said material includes at least one band on each of the side portions which separates the side portion from the associated handle portion.

16. A game racquet comprising:

a) a head portion, the head portion being adapted to support a string bed and having a top and opposite side portions and a longitudinal centerline, each of the side portions extending downwardly and toward the longitudinal centerline of the head, b) a pair of handle portions, each of the handle portions having a substantially straight bottom portion which is positioned adjacent the longitudinal centerline of the head and a curved top portion which curves upwardly and away from the longitudinal centerline of the head and which is frictionally engaged with, and removable from, one of the side portions of the head, the handle portions being separate from each other and each handle portion including a substantially flat inside surface which abuts the inside surface of the other handle portion.

17. The racquet of claim 16 in which each of the handle portions includes a projection which extends beyond the flat inside surface of the handle portion and into a recess in the other handle portion.

18. The racquet of claim 16 further comprising material selected from the class of dampening material, absorbing material, and resilient material inserted between the side portions and the handle portions.

19. The racquet of claim 18 wherein the material is in the form of bands positioned on the curved top portion of each of the handle portions.

20. A game racquet comprising:

a) a head portion, the head portion being adapted to support a string bed and having a top and opposite side portions and a longitudinal centerline, each of the side portions extending downwardly and toward the longitudinal centerline of the head, b) a pair of handle portions, each of the handle portions having a substantially straight bottom portion which is positioned adjacent the longitudinal centerline of the head and a curved top portion which curves upwardly and away from the longitudinal centerline of the head and which is frictionally engaged with, and removable from, one of the side portions of the head, each of the side portions and each of the handle portions being provided with a string hole for receiving a racquet string.

21. The racquet of claim 20 further comprising material selected from the class of dampening material, absorbing material, and resilient material inserted between the side portions and the handle portions.

22. The racquet of claim 21 wherein the material is in the form of bands positioned on the curved top portion of each of the handle portions.

* * * * *